US005813546A

United States Patent [19]

Wilson et al.

[11] Patent Number: 5,813,546

[45] Date of Patent: Sep. 29, 1998

[54] CAP DISPLAY APPARATUS

[76] Inventors: Stephen M. Wilson; Joseph J. Catalano, both of 16415 Addison Rd. Suite 620, Dallas, Tex. 75248

[21] Appl. No.: 558,422

[22] Filed: Nov. 16, 1995

[51] Int. Cl.[6] ..... A47F 7/06

[52] U.S. Cl. ..... 211/32; 206/8; 206/461; 206/471; D9/320; D9/415; D9/418

[58] Field of Search ..... 211/32; 206/8, 206/471, 461, 497; D9/418, 415, 320

[56] References Cited

U.S. PATENT DOCUMENTS

| | | | |
|---|---|---|---|
| D. 355,600 | 2/1995 | Ford | D9/415 |
| 3,488,413 | 1/1970 | Watts, Jr. | 206/471 X |
| 4,453,629 | 6/1984 | Goldberg | 206/471 X |
| 4,485,921 | 12/1984 | Geller | 206/471 |
| 4,653,642 | 3/1987 | Hakun et al. | 206/471 X |
| 4,730,726 | 3/1988 | Holzwarth | 206/471 X |
| 4,905,828 | 3/1990 | Dods | 206/461 X |
| 5,012,531 | 5/1991 | Schoonover | 206/8 X |
| 5,022,515 | 6/1991 | Agostine | 206/8 |
| 5,447,230 | 9/1995 | Derondale | 206/467 X |
| 5,480,023 | 1/1996 | Puller | 206/8 |

FOREIGN PATENT DOCUMENTS

| | | | |
|---|---|---|---|
| 2410611 | 8/1979 | France | 206/461 |

*Primary Examiner*—Ramon O. Ramirez
*Assistant Examiner*—Donald J. Wallace
*Attorney, Agent, or Firm*—W. Thomas Timmons; Timmons & Kelly

[57] ABSTRACT

A piece of transparent material has a hollow form extending away from a planar surface. The hollow form has a crown section and a bill section, both sections having a common bottom face. The inner dimensions of the crown section correspond to the outer dimensions of the crown when the back half of the crown is folded in back of the front half of the crown. The inner dimensions of the bill section correspond to the outer dimensions of the bill. A baseball style cap fits within the cavity formed by the crown section and the bill section. Backing material contacts the window piece against its rear surface and can be seen through the window piece. A frame holds the window piece, the backing material, and a rigid back piece together. The entire structure is mounted on a vertical surface such as a wall, for displaying the cap. A secondary display area below the hollow form is created by removing some of the backing material. This secondary display area permits displaying a ticket associated with the cap, or another thin flat object.

15 Claims, 2 Drawing Sheets

CAP DISPLAY APPARATUS

BACKGROUND OF THE INVENTION

1. Field of the Invention

This invention relates in general to display devices. In particular, the invention relates to a display device suitable for mounting on a wall, for displaying a cap having a bill connected to a collapsible crown, such as a baseball cap.

2. Description of the Related Art

Display cases have been designed to show off various types of personal mementos, from trophies to golf balls. One type of memento that has increased in popularity is a cap associated with a particular sport or team, or commemorating a special event. Examples include the traditional baseball cap and caps issued for golf tournaments, automobile races and the like. Often, the owner will have a famous sports figure autograph the cap, thereby greatly increasing its personal and market value. Ironically, these valuable items are quite often simply displayed on an open shelf, where it becomes covered with dust that works its way into the cloth in the cap. In addition, the cap is potentially exposed to damage from spills, stains, and fading from ultraviolet light. A display device would preserve and protect the cap from these hazards.

At this time, no display case known to the inventor is properly adapted to display a cap. The traditional, cubical display case is bulky and too expensive for many individual collectors. Also, since the cap is best viewed at about eye level, a desirable location for display would be on a wall, at about eye level, with the cap canted so that both the bill and the front of the crown can be viewed simultaneously with equal prominence.

SUMMARY OF THE INVENTION

The general object of the invention is to display a cap having a bill and a collapsible head cover. Another object is to protect the cap from dust, chemicals, stains and fading from ultraviolet light. A third object is to display tickets or other mementos associated with a special event along with the cap.

In general, these objects are achieved by a window piece made of a transparent, planar piece of plastic material, having a hollow, specially shaped form extending away from the front surface of the window piece. The specially shaped form has a crown section and a bill section with internal dimensions corresponding to, but slightly greater than, the dimensions of a standard cap. The cap is held within the cavity created by the specially shaped hollow form.

Backing material is placed against the rear surface of the window piece, with the front surface of the backing material showing through the front surface of the window piece. A rigid back provides strength and rigidity to the structure. The window piece, the backing material, and the rigid back are held, sandwiched together, within a rectangular frame made of aluminum.

A secondary display section can be fashioned by cutting out a predetermined area of the backing material below the hollow form. This secondary display section can be used to display a ticket or other mementos associated in some way with the cap.

An alternative embodiment has a number of window pieces, each with its own hollow form, assembled into an array. The array is sandwiched together with a single piece of backing material and a single rigid back within a large frame.

The above, as well as additional objects, features, and advantages of the invention will become apparent in the following detailed description.

DESCRIPTION OF THE PREFERRED EMBODIMENTS

Figure 1:
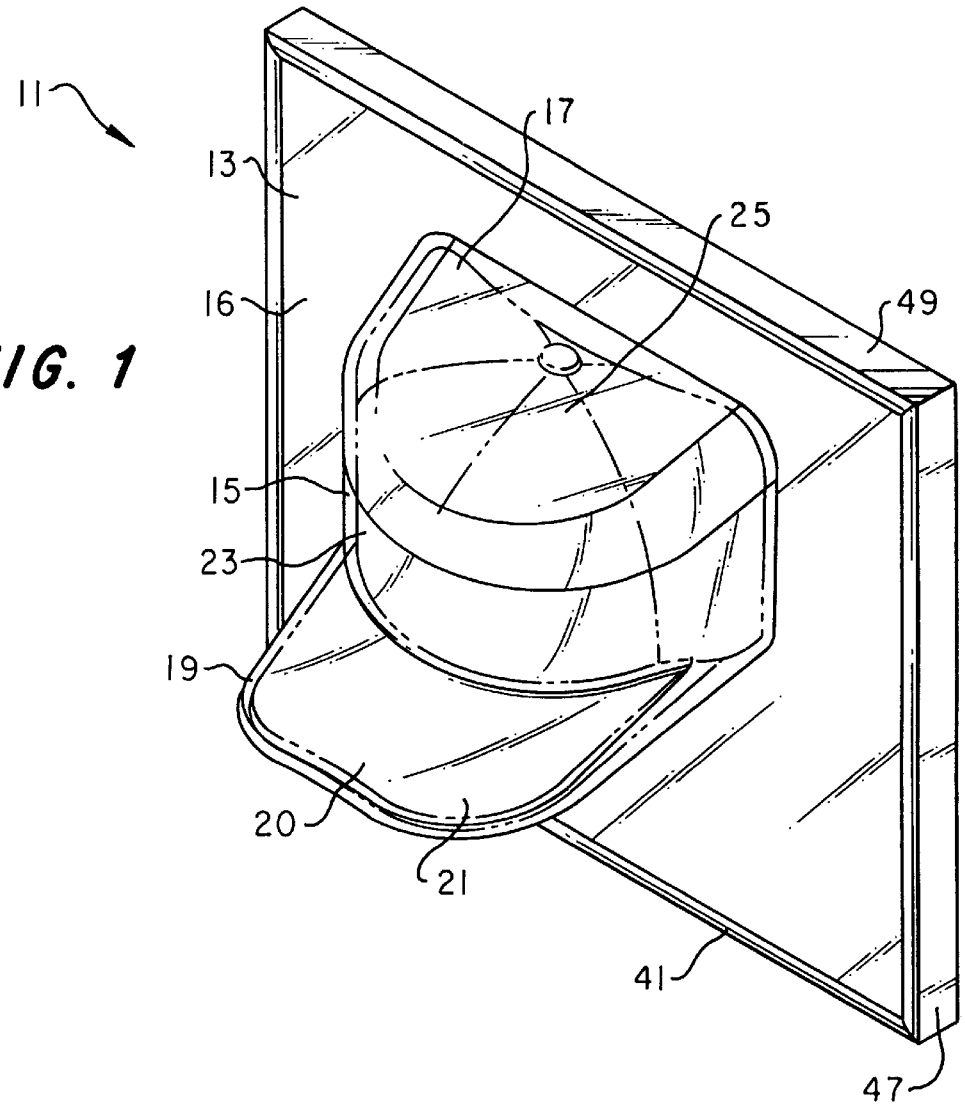
FIG. 1 is a perspective view of the preferred embodiment of a cap display of the invention as it appears when in use.

As shown in FIG. 1, the cap display 11 includes a window piece 13 made of a sheet of transparent plastic, such as polyethylene glycol-co-cyclohexane-1,4-dimethanol terepthalate (PETG). A hollow form 15 is fashioned out of the front surface 16 of the window piece 13, using an injection molding process, a vacuum molding process or the like. The material used should be thick enough to provide sufficient rigidity and strength, preferably at least 1.5 millimeters thick. The material should also act as an ultraviolet (UV) light shield, to help prevent the colors in the cap 21 from fading over time. If UV shielding is not an inherent property of the material, then a UV protective coating should be applied to the window piece 13 and the hollow form 15.

Figure 2:
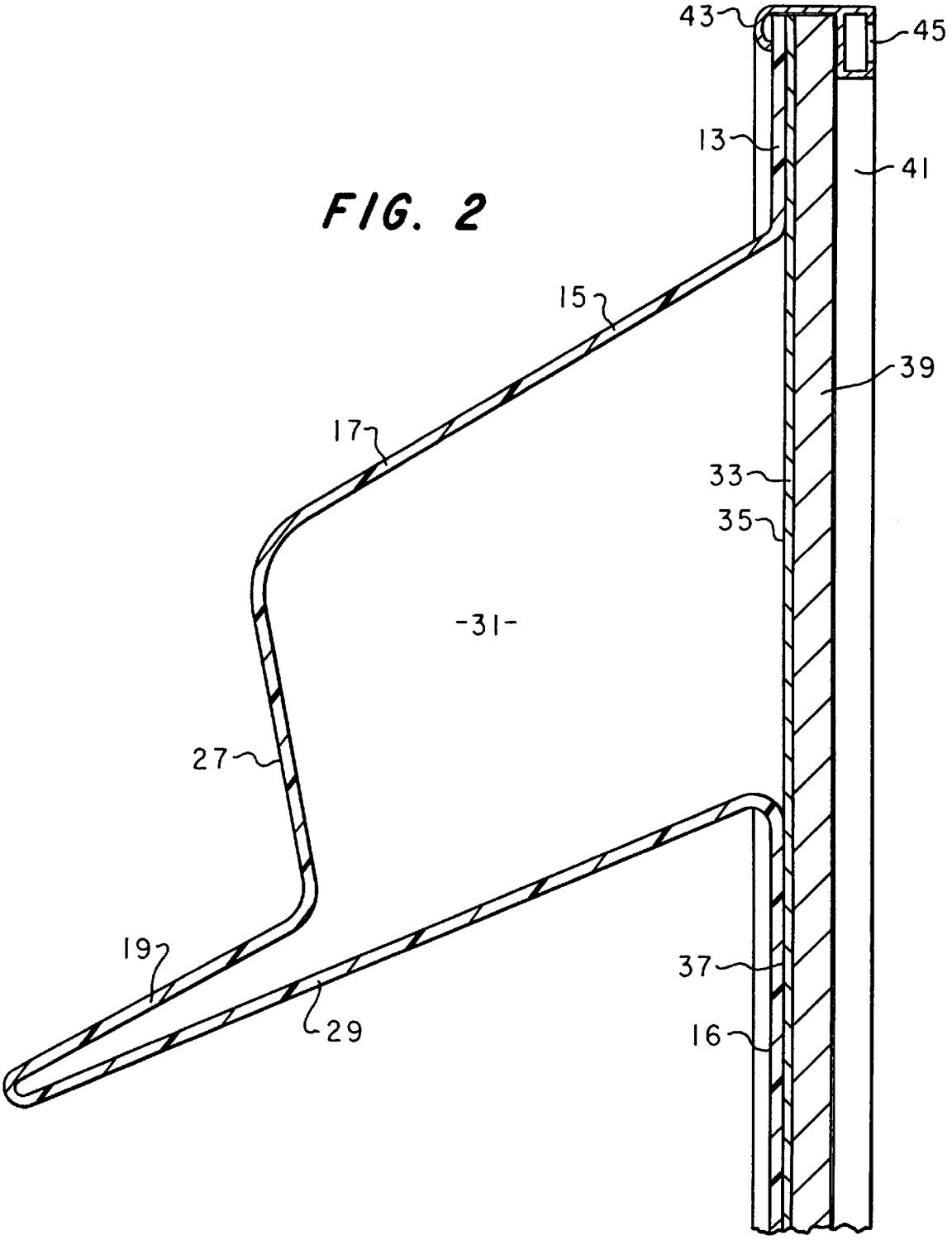
FIG. 2 is a cross-sectional right side elevation thereof, without a cap in the display.

The hollow form 15 includes a crown section 17 and a bill section 19, designed to hold a cap 21. As shown in FIGS. 1 and 2, the hollow crown section 17 has internal dimensions that correspond to the dimensions of the front half 23 of the crown 25, but are slightly larger. The crown 25 of the cap 21 is folded in half to fit within the crown section 17, with the rear half (not shown) of the crown 25 touching the front half 23 of the crown 25. Displaying only the front half 23 of the crown 25 helps reduce the total distance the hollow form 15 stands out from the window piece 13, resulting in greater durability and crack resistance of the hollow form 15 and the window piece 13. Alternative embodiments can be used having a crown section 17 capable of displaying the entire crown 25 in its unfolded state, or an amount in between half and all of the crown 25.

The bill section 19 extends out of the front surface 27 of the crown section 17. The inner dimensions of the bill section 19 correspond to the dimensions of the bill 20 of the cap 21, but are slightly larger. The bill section 19 and the crown section 17 share a common bottom face 29 so that, as seen in FIG. 2, the cross-sectional profile of the hollow form 15 looks roughly the same as the profile of a cap, minus the rear half of the crown.

The cavity 31 created by the hollow form 15 holds the cap 21 for display. The hollow form 15 is canted with respect to the window piece 13. The bottom face 29 forms about a seventy degree angle with the window piece 13, so that the hollow form 15 slopes down at about a twenty degree angle from horizontal when the display 11 is mounted on a wall (not shown).

A piece of backing material 33 provides a contrasting background for the cap 21. The backing material 33 is made of conventional matting material used for picture framing, and has roughly the same width and height as the window piece 13. The display surface 35 of the backing material 33 contacts the rear surface 37 of the window piece 13. Thus, the display surface 35 shows through the front surface 16 of the window piece 13. A rigid back 39, made of chipboard or other suitable material, contacts the backing material 33 and provides support and rigidity to both the window piece 13 and the backing material 33.

A rectangular frame 41 holds the window piece 13, the backing material 33, and the rigid back 39 together. The frame 41 is made from extruded aluminum, cut and formed into two pieces: a U-shaped, first frame piece 47 that makes up three of the four sides of the frame 41; and a second frame piece 49 making up the fourth side of the frame 41. The frame 41 has a semicircular, front retaining edge 43 and a box-shaped, rear retaining edge 45, spaced apart so that the window piece 13, the backing material 33, and the rigid back 39 are urged to remain in intimate contact with each other, the framed elements being slightly compressed between the front retaining edge 43 and the rear retaining edge 45. This state of compression promotes rigidity of the overall structure and can help straighten out minor, nonplanar deformations in the window piece 13 and the backing material 33.

The display 11 is assembled by placing the cap 21 within the cavity 31, and sandwiching the window piece 13, the backing material 33, and the rigid back 39 together as shown in FIG. 2. The three pieces are then slid completely into the first frame piece 47. The second frame piece 49 is then secured to the first frame piece 47 using means well known in the art. The assembled display 11 can then be mounted on a wall (not shown) in the same manner as mounting a framed picture.

Figure 3:
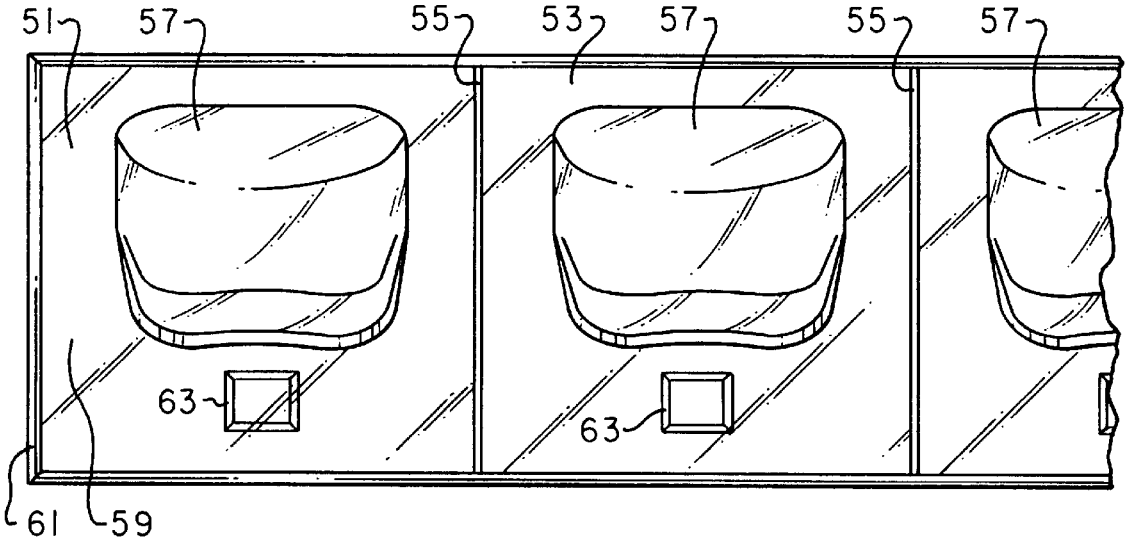
FIG. 3 is a front elevation of an alternative embodiment of the invention.

FIG. 3 depicts a second embodiment of the invention. In this embodiment, a number of individual window pieces 51 are assembled into an array 53. The window pieces 51 are separated by retaining bars 55, as in a multi-paned window. Alternatively, a single window piece 51 having a number of hollow forms 57 can be used. A single piece of backing material 59 and a single rigid back piece (not shown) support and contact the array 53. The second embodiment is assembled in the same manner as the preferred embodiment, except that the backing material 59 and the rigid back are assembled first, then the array 53 is assembled on top of the backing material 59, prior to sliding the sandwiched pieces into the first frame piece 61.

As an optional feature, a secondary display section 63 can be formed by removing some of the backing material 59 below the hollow form 15. This secondary display section 63 can be sized and shaped to accommodate a single ticket (not shown), or a number of tickets in a fan layout. This permits the cap's collector to simultaneously display tickets to an event associated with the cap (not shown). Alternative embodiments (not shown) are envisioned, in which a second hollow form (not shown) can be formed out of the window piece 51 below the hollow form 57, using the same method used to make the hollow form 57. This second hollow form would be adapted for displaying a golf ball, a baseball, or other small memento associated with the cap being displayed. Of course, the secondary display section 63 and the second hollow form (not shown) can be used in the preferred embodiment of FIGS. 1 and 2 as well.

The invention has been shown in only two embodiments. It should be apparent to those skilled in the art that the invention is not limited to these embodiments, but is susceptible to various changes and modifications without departing from the scope of the claims and the spirit of the invention.

It will be understood that certain features and sub combinations are of utility and may be employed without reference to other features and sub combinations. This is contemplated by and is within the scope of the claims.

As many possible embodiments may be made of the invention without departing from the scope thereof, it is to be understood that all matter herein set forth or shown in the figures of the accompanying drawings is to be interpreted as illustrative and not in a limiting sense.

We claim:

1. A cap display apparatus for displaying a cap having a bill and a collapsible crown, the crown having a front half connected to the bill, wherein the cap display comprises:

a transparent planar window piece, having a front surface and a rear surface;

an integral, transparent, hollow crown section extending out of the front surface of the window piece, the crown section having internal dimensions corresponding to, but slightly larger than the dimensions of at least the front half of the cap crown; and an integral, transparent, hollow bill section, extending out of the crown section away from the front surface of the window piece, the bill section having internal dimensions corresponding to, but slightly larger than the dimensions of the bill, the crown section and the bill section together being canted with respect to the window piece for displaying the cap at a preselected angle.

2. A cap display as recited in claim 1, further comprising:

backing material having a rear surface and a display surface that faces the rear surface of the window piece; and a frame designed to accept and hold the window piece and the backing material together, for displaying the cap within the crown section and the bill section.

3. A cap display as recited in claim 2, further comprising a rigid back, located next to the backing material, adapted to fit within the frame between the rear surface of the backing material and the frame.

4. A cap display as recited in claim 3, further comprising a secondary display section defined within the backing material, for displaying a thin, flat object.

5. A cap display as recited in claim 1, wherein the window piece, the crown section and the bill section are formed from a single piece of transparent plastic material.

6. A cap display as recited in claim 5, wherein the plastic material is chosen from the group of polyethylene glycol-co-cyclohexane-1,4-dimethanol terepthalate, polyethylene terepthalate, and acrylic resin.

7. A cap display as recited in claim 1, wherein the crown section and the bill section have a common, roughly planar bottom face.

8. A cap display as recited in claim 1, wherein the cap display shields the cap from ultraviolet radiation when the cap is stored in the cap display.

9. A cap display apparatus for displaying a plurality of caps each having a bill and a collapsible crown, the crown having a front half connected to the bill, wherein the cap display comprises:

a plurality of transparent planar window pieces, each piece having a front surface and a rear surface;

a plurality of integral, transparent, hollow crown sections, each crown section extending out of the front surface of one of the window pieces, each crown section having internal dimensions corresponding to, but slightly larger than the dimensions of at least the front half of the cap crown;

a plurality of integral, transparent, hollow bill sections, each bill section extending out of one of the crown sections away from the front surface of the window piece, each bill section having internal dimensions corresponding to, but slightly larger than the dimensions of the bill, the crown section and the bill section together being canted with respect to the window piece for displaying the cap at a preselected angle;

at least one retaining bar, for holding the window pieces together, the combination of the window pieces and the retaining bars forming an array;

backing material adjacent to the window pieces; and a frame designed to accept and hold the window pieces, the retaining bars, and the backing material together, for displaying the caps within the crown sections and the bill sections.

10. A cap display as recited in claim 9, further comprising a rigid back, located next to the backing material, adapted to fit within the frame between the backing material and the frame.

11. A cap display as recited in claim 10, further comprising a secondary display section defined within the backing material, for displaying a thin, flat object.

12. A cap display as recited in claim 9, wherein the cap display shields the cap from ultraviolet radiation when the cap is stored in the cap display.

13. A cap display apparatus for displaying a plurality of caps each having a bill and a collapsible crown, the crown having a front half connected to the bill, wherein the cap display comprises:

a transparent planar window piece, having a front surface and a rear surface;

a plurality of integral, transparent, hollow crown sections extending out of the front surface of the window piece, each crown section having internal dimensions corresponding to, but slightly larger than the dimensions of at least the front half of the cap crown; and a plurality of integral, transparent, hollow bill sections, each bill section extending out of one of the crown sections away from the front surface of the window piece, the bill sections having internal dimensions corresponding to, but slightly larger than the dimensions of the bill, the crown section and the bill section together being canted with respect to the window piece for displaying the cap at a preselected angle.

14. A cap display as recited in claim 13, further comprising:

backing material having a rear surface and a display surface that faces the rear surface of the window piece, and;

a frame designed to accept and hold the window piece and the backing material together, for displaying the caps within the crown sections and the bill sections.

15. A cap display as recited in claim 13, wherein the cap display shields the cap from ultraviolet radiation when the cap is stored in the cap display.

* * * * *